US008770569B2

(12) United States Patent
Furuhashi et al.

(10) Patent No.: US 8,770,569 B2
(45) Date of Patent: Jul. 8, 2014

(54) SHEET PROCESSING APPARATUS, IMAGE FORMING SYSTEM, AND SHEET PROCESSING METHOD

(71) Applicants: Tomohiro Furuhashi, Kanagawa (JP); Masahiro Tamura, Kanagawa (JP); Shuuya Nagasako, Kanagawa (JP); Keisuke Sugiyama, Tokyo (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Kazunori Konno, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(72) Inventors: Tomohiro Furuhashi, Kanagawa (JP); Masahiro Tamura, Kanagawa (JP); Shuuya Nagasako, Kanagawa (JP); Keisuke Sugiyama, Tokyo (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Kazunori Konno, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/660,067

(22) Filed: Oct. 25, 2012

(65) Prior Publication Data

US 2013/0113154 A1 May 9, 2013

(30) Foreign Application Priority Data

Nov. 4, 2011 (JP) ..... 2011-242545

(51) Int. Cl.
*B65H 37/04* (2006.01)

(52) U.S. Cl.
USPC ..... 270/58.11; 270/58.17; 270/58.09

(58) Field of Classification Search
USPC ..... 270/58.08, 58.11, 58.12, 58.16, 58.17
See application file for complete search history.

(56) References Cited

U.S. PATENT DOCUMENTS

| | | | | |
|---|---|---|---|---|
| 7,416,177 | B2 * | 8/2008 | Suzuki et al. | 270/37 |
| 7,434,796 | B2 * | 10/2008 | Kushida | 270/58.08 |
| 7,575,229 | B2 * | 8/2009 | Kushida | 270/58.08 |
| 7,597,312 | B2 * | 10/2009 | Nishioka | 270/58.12 |
| 7,946,569 | B2 * | 5/2011 | Suzuki et al. | 270/58.12 |
| 7,988,139 | B2 * | 8/2011 | Matsuura | 270/58.12 |
| 8,297,610 | B2 * | 10/2012 | Shiraishi | 270/58.09 |
| 8,485,514 | B2 * | 7/2013 | Sugiyama et al. | 270/58.09 |
| 8,496,239 | B2 * | 7/2013 | Furuhashi et al. | 270/58.09 |

(Continued)

FOREIGN PATENT DOCUMENTS

| | | |
|---|---|---|
| JP | 2008-156073 | 7/2008 |
| JP | 2009-263127 | 11/2009 |
| JP | 2012-126515 | 7/2012 |

*Primary Examiner* — Patrick Mackey
(74) *Attorney, Agent, or Firm* — Harness, Dickey & Pierce, P.L.C.

(57) ABSTRACT

A sheet processing apparatus is disclosed which includes front and back trailing-end reference fences that are movable and on which the sheet trailing-end abuts to align the sheet trailing-end; a side-stitching stapler that moves along the sheet trailing-end and binds a bundle of sheets aligned; a length-direction moving mechanism that moves the trailing-end reference fences in a sheet conveying direction; and a position changing unit that drives the length-direction moving mechanism to change the position of one of the trailing-end reference fences in the sheet conveying direction relative to the position of the other one. The front and back trailing-end reference fences are moved to change binding positions such that the distances from the sheet trailing-end to staple positions are made equal in front-side binding and in back-side binding.

3 Claims, 11 Drawing Sheets

(56) References Cited

U.S. PATENT DOCUMENTS

| | | | | |
|---|---|---|---|---|
| 2006/0279037 | A1* | 12/2006 | Kushida et al. | 270/58.08 |
| 2007/0096381 | A1* | 5/2007 | Nishioka | 270/58.12 |
| 2008/0179809 | A1 | 7/2008 | Kikkawa et al. | |
| 2009/0218746 | A1* | 9/2009 | Matsuura | 270/58.08 |
| 2010/0219576 | A1* | 9/2010 | Yamamoto | 270/58.08 |
| 2011/0248440 | A1 | 10/2011 | Sugiyama et al. | |
| 2011/0266738 | A1 | 11/2011 | Furuhashi et al. | |
| 2012/0146279 | A1 | 6/2012 | Furuhashi et al. | |
| 2012/0153556 | A1 | 6/2012 | Sugiyama et al. | |

* cited by examiner

SHEET PROCESSING APPARATUS, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2011-242545 filed in Japan on Nov. 4, 2011.

BACKGROUND OF THE INVENTION

1. Field of the Invention

The present invention relates to a sheet processing apparatus that aligns and binds sheet-like recording media such as paper sheets, recording paper, transfer paper, and OHP transparent sheets (in the present specification, simply referred to as sheets) conveyed, an image forming system that includes the sheet processing apparatus and an image forming apparatus such as a copying machine, a printer, a facsimile, or a digital multi-function peripheral (MFP), and a sheet processing method performed in the sheet processing apparatus.

2. Description of the Related Art

There has been a known device referred to as a finisher provided with a stapler that stacks sheets discharged from an image forming apparatus on a staple tray, aligns the sheets in a conveying direction (i.e., vertical direction) and in a direction orthogonal to the conveying direction (i.e., width direction), and then binds the sheets. When the stapler performs side stitching that binds the sheets at an edge face of the sheet, the stapler can move in the direction orthogonal to the sheet conveying direction along the end portion of the sheets (normally, trailing ends of sheets) in a state where the sheets are stopped on reference fences that define the position of the sheets in the conveying direction and are held in the stopped state (hereinafter, referred to as abutting) so as to change a binding position.

However, in a conventional construction of a side-stitching processor, the trailing end of the sheet is stopped on the reference fences to align, and the positional relationship between the reference fences and a staple unit in the conveying direction in an end binding process is fixed. Therefore, it is not allowed to adjust the binding position in the sheet conveying direction to a position desired by an individual user in the end binding process.

Accordingly, for example, Japanese Patent Application Laid-open No. 2008-156073 discloses an invention of a sheet processing apparatus that performs a given process on sheets conveyed and discharges the sheets and that makes a retracting structure of a binding device and a driving source for trailing-end fences unnecessary to achieve space-saving at low cost. The sheet processing apparatus includes an intermediate tray that temporarily receives and stacks the sheets conveyed, the trailing-end fences that abut on the trailing ends of a plurality of sheets stacked on the intermediate tray and conveys the sheets to a transferring position, an ejecting claw that takes over the conveyance of the sheets subsequent to the transferring position from the trailing-end fences and delivers the sheets out from the intermediate tray, and a conveying drive mechanism that drives the trailing-end fences and the ejecting claw by the driving force of a single motor.

Furthermore, Japanese Patent Application Laid-open No. 2009-263127 discloses an invention of a sheet post-processing apparatus that reliably makes the leading ends of sheets abut on leading-end stoppers, so that the alignment can be performed. The sheet post-processing apparatus includes discharging rollers that convey sheets discharged from an image forming apparatus and discharge the sheets to a slantingly arranged aligning tray to stack the sheets, and the movable leading-end stoppers that align the sheets in a conveying direction by making the trailing ends of the sheets abut on stopping surfaces of reference fences after pressing the leading ends of the sheets discharged to the aligning tray, and the pressing amount of the leading-end stoppers in the sheet conveying direction is made variable.

However, when the trailing-end reference fences (leading-end stoppers) in front and back have positional deviations in the conveying direction due to a mechanical error arisen in assembling and such, because the stacked sheets are stacked at an angle, and thus, even when the pressing amount of the leading-end stoppers is made variable, the inclination of the sheets is not eliminated. Consequently, the binding depths in the conveying (sub-scanning) direction are not equal when the sheets are bound on front side and when bound on back side, whereby the binding depths are not aligned to an intended depth.

Accordingly, an object of the present invention is to align the binding positions in the sub-scanning direction regardless of the binding position.

SUMMARY OF THE INVENTION

It is an object of the present invention to at least partially solve the problems in the conventional technology.

A sheet processing apparatus comprising: a pair of alignment members that is movable along a sheet-conveying direction trailing-end portion and on which the sheet conveying direction trailing-end portion of a sheet abuts to align the sheet-conveying direction trailing-end portion; a binding unit that moves along the sheet-conveying direction trailing-end portion and binds a bundle of sheets aligned; a moving unit that moves the alignment members in a sheet conveying direction; and a position changing unit that drives the moving unit to change a position of one of the alignment members in the sheet conveying direction relative to a position of the other one of the alignment members in the sheet conveying direction.

An image forming system including a sheet processing apparatus, the sheet processing apparatus comprising: a pair of alignment members that is movable along a sheet-conveying direction trailing-end portion and on which the sheet conveying direction trailing-end portion of a sheet abuts to align the sheet-conveying direction trailing-end portion; a binding unit that moves along the sheet-conveying direction trailing-end portion and binds a bundle of sheets aligned; a moving unit that moves the alignment members in a sheet conveying direction; and a position changing unit that drives the moving unit to change a position of one of the alignment members in the sheet conveying direction relative to a position of the other one of the alignment members in the sheet conveying direction.

A sheet processing method for binding a sheet bundle performed by a binding unit in a sheet processing apparatus including a pair of alignment members that are movable along a sheet-conveying direction trailing-end portion and on which the sheet-conveying direction trailing-end portion of a sheet abuts to align the sheet-conveying direction trailing-end portion, the binding unit that moves along the sheet-conveying direction trailing-end portion and binds a bundle of sheets aligned, and a moving unit that moves the alignment members in a sheet conveying direction.

The sheet processing method comprising: changing binding positions of the sheet bundle by moving the alignment members by using the moving unit in the sheet conveying direction such that distances from the sheet-conveying direction trailing-end portion to the binding positions are made equal in front-side binding and in back-side binding.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention allows alignment positions of reference fences in a sheet conveying direction to be changed in front-side binding and in back-side binding, so that binding positions in a sub-scanning direction can be set to the same position regardless of the binding position.

In the following, an exemplary embodiment of the present invention will be described with reference to the accompanying drawings.

Figure 1:
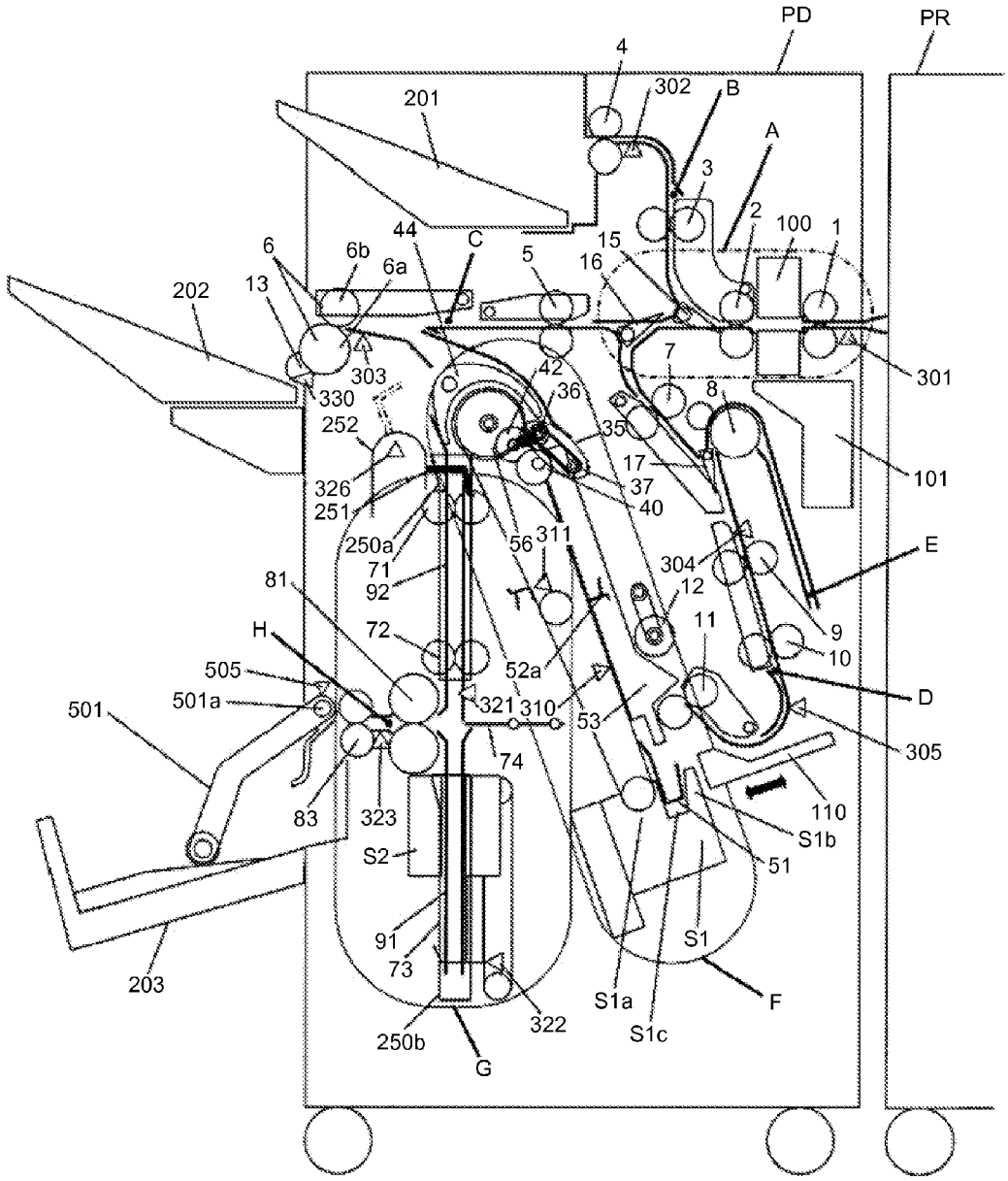
FIG. 1 is a schematic diagram illustrating a system configuration of a system composed of a sheet post-processing apparatus as a sheet processing apparatus and an image forming apparatus according to an embodiment of the present invention.

FIG. 1 is a schematic diagram illustrating a system configuration of a system composed of a sheet post-processing apparatus PD as a sheet processing apparatus and an image forming apparatus PR according to the present embodiment.

In FIG. 1, the image forming apparatus PR includes at least an image processing circuit that converts image data received to printable image data, an optical writing device that performs optical writing on a photosensitive element based on an image signal output from the image processing circuit, a developing device that performs toner development of a latent image formed on the photosensitive element by the optical writing, a transferring device that transfers the toner image visualized by the developing device onto a sheet, and a fixing device that fixes the transferred toner image onto the sheet. The image forming apparatus PR discharges the sheet on which the toner image is fixed to the sheet post-processing apparatus PD by which a desired post-processing is performed on the sheet. While the image forming apparatus PR is of an electrophotography type as in the foregoing, image forming apparatuses of all known types such as an inkjet type and a thermal transfer type can be used. In the present embodiment, the image processing circuit, the optical writing device, the developing device, the transferring device, and the fixing device constitute an image forming unit.

The sheet post-processing apparatus PD is attached to a side portion of the image forming apparatus PR, and a sheet ejected from the image forming apparatus PR is guided into the sheet post-processing apparatus PD. The sheet post-processing apparatus PD includes a conveying path A, a conveying path B, a conveying path C, a conveying path D, and a conveying path H, and the sheet is first conveyed to the conveying path A where a post-processing unit that performs a post-processing on a single sheet (in the present embodiment, a punch unit 100 as a punching unit) is provided.

The conveying path B is a conveying path that passes through the conveying path A and leads to an upper tray 201, and the conveying path C is a conveying path that leads to a shift tray 202. The conveying path D is a conveying path that leads to a process tray F (hereinafter, also referred to as a side-stitching process tray) that performs alignment, staple binding, and others. The conveying paths from the conveying path A to the respective conveying paths B, C, and D are configured to be sorted by a bifurcating claw 15 and a bifurcating claw 16.

The sheet post-processing apparatus PD can perform, on a sheet, various processes such as punching (the punch unit 100), sheet alignment plus side-stitching (jogger fences 53 and a side-stitching stapler S1 (S1*a*, S1*b*, S1*c*)), sheet alignment plus saddle-stitching (an upper saddle-stitching jogger fence 250*a* and a lower saddle-stitching jogger fence 250*b*, a saddle-stitching stapler S2), sorting of sheets (the shift tray 202), and center folding (a folding plate 74 and folding rollers 81). Therefore, the conveying path A and a subsequent path of the conveying path B, the conveying path C, or the conveying path D are appropriately selected. The conveying path D further includes a sheet accommodating unit E, and on the downstream side of the conveying path D, the side-stitching process tray F, a saddle-stitching center-folding process tray G, and the discharge conveying path H are provided.

In the conveying path A that is common to and at the upstream of the conveying path B, the conveying path C, and the conveying path D, an entrance sensor 301 that detects a sheet received from the image forming apparatus PR, and at the downstream thereof, entrance rollers 1, the punch unit

100, a punch-waste hopper 101, conveying rollers 2, the first bifurcating claw 15, and the second bifurcating claw 16 are arranged in the foregoing order. The first bifurcating claw 15 and the second bifurcating claw 16 are held in a state illustrated in FIG. 1 by springs not depicted (an initial state), and turning on a first solenoid or a second solenoid not depicted drives the first bifurcating claw 15 or the second bifurcating claw 16, respectively. Selectively turning the first and the second solenoids on and off changes the combination of bifurcating directions of the first bifurcating claw 15 and the second bifurcating claw 16, whereby a sheet is sorted to one of the conveying path B, the conveying path C, and the conveying path D.

When guiding a sheet to the conveying path B, the state depicted in FIG. 1 is held as is, more specifically, the first solenoid is turned off (the first bifurcating claw 15 is positioned downwards in the initial state). Accordingly, sheet passes conveying rollers 3 and through discharge rollers 4, and is ejected to the upper tray 201.

When guiding a sheet to the conveying path C, the first and the second solenoids are turned on (the second bifurcating claw 16 is positioned upward in the initial state), whereby the first bifurcating claw 15 is turned upward and the second bifurcating claw 16 is turned downwards. Accordingly, the sheet is conveyed through conveying rollers 5 and a pair of discharging rollers 6 (6*a* and 6*b*) to the shift tray 202 side. In this case, sorting of sheets is performed. The sheet sorting is performed by the pair of shift discharging rollers 6 (6*a* and 6*b*), a reverse roller 13, a sheet detecting sensor 330, the shift tray 202, a shifting mechanism not depicted that moves the shift tray 202 back and forth in a direction orthogonal to a sheet conveying direction, and a shift-tray lifting mechanism that lifts the shift tray 202 up and down.

When guiding a sheet to the conveying path D, turning on the first solenoid that drives the first bifurcating claw 15 and turning off the second solenoid that drives the second bifurcating claw 16 make both the first bifurcating claw 15 and the second bifurcating claw 16 turn upward, whereby the sheet is guided through the conveying rollers 2 and conveying rollers 7 to the conveying path D side. The sheet guided to the conveying path D is further guided to the side-stitching process tray F where alignment, stapling, and such are performed on the sheet. The sheet aligned and stapled is then sorted, by a guide member 44, to the conveying path C leading to the shift tray 202 or to the saddle-stitching center-folding process tray G where folding and others are performed (hereinafter, also simply referred to as a saddle-stitching process tray). When guided to the shift tray 202, a bundle of sheets is discharged from the pair of discharging rollers 6 to the shift tray 202. The sheet bundle guided to the saddle-stitching process tray G side is folded and bound in the saddle-stitching process tray G, and is discharged from discharging rollers 83 to a lower tray 203 passing through the discharge conveying path H.

Meanwhile, in the conveying path D, a bifurcating claw 17 is arranged and is held in a state depicted in FIG. 1 by a low-load spring not depicted. The bifurcating claw 17 allows conveying a sheet backwards along a turn guide 8, after the trailing end of the sheet conveyed by the conveying rollers 7 is passed the bifurcating claw 17, by backwards rotating at least conveying rollers 9 out of the conveying rollers 9, conveying rollers 10, and staple discharging rollers 11, whereby the sheet with the trailing end ahead is guided to the sheet accommodating unit E to be retained (pre-stacked) such that the sheet is conveyed with a subsequent sheet being overlaid. Repeating this operation allows conveying two or more sheets being overlaid with one another. A reference numeral 304 represents a pre-stack sensor for setting a timing to move backwards when pre-stacking the sheets.

When guiding to the conveying path D and sheet alignment and side-stitching are performed, the sheets guided to the side-stitching process tray F by the staple discharging rollers 11 are stacked on the side-stitching process tray F in sequence. In this case, for each sheet, the alignment in a vertical direction (sheet conveying direction) is performed by a tapping roller 12 and trailing-end reference fences 51, and the alignment in a horizontal direction (a direction orthogonal to the sheet conveying direction, also referred to as a sheet width direction) is performed by the jogger fences 53. At a hiatus between jobs, more specifically, between the last sheet of a preceding sheet bundle and the first sheet of a subsequent sheet bundle, the side-stitching stapler S1 as a binding unit is driven by a staple signal from a controller not depicted, and thus a binding process is performed. The sheet bundle on which the binding process is performed is immediately sent to the shift discharging rollers 6 by an ejecting belt 52 (see FIG. 2) on which ejecting claws 52*a* are provided in a projecting manner, and the sheet bundle is discharged to the shift tray 202 that is set at a receiving position.

Figure 2:
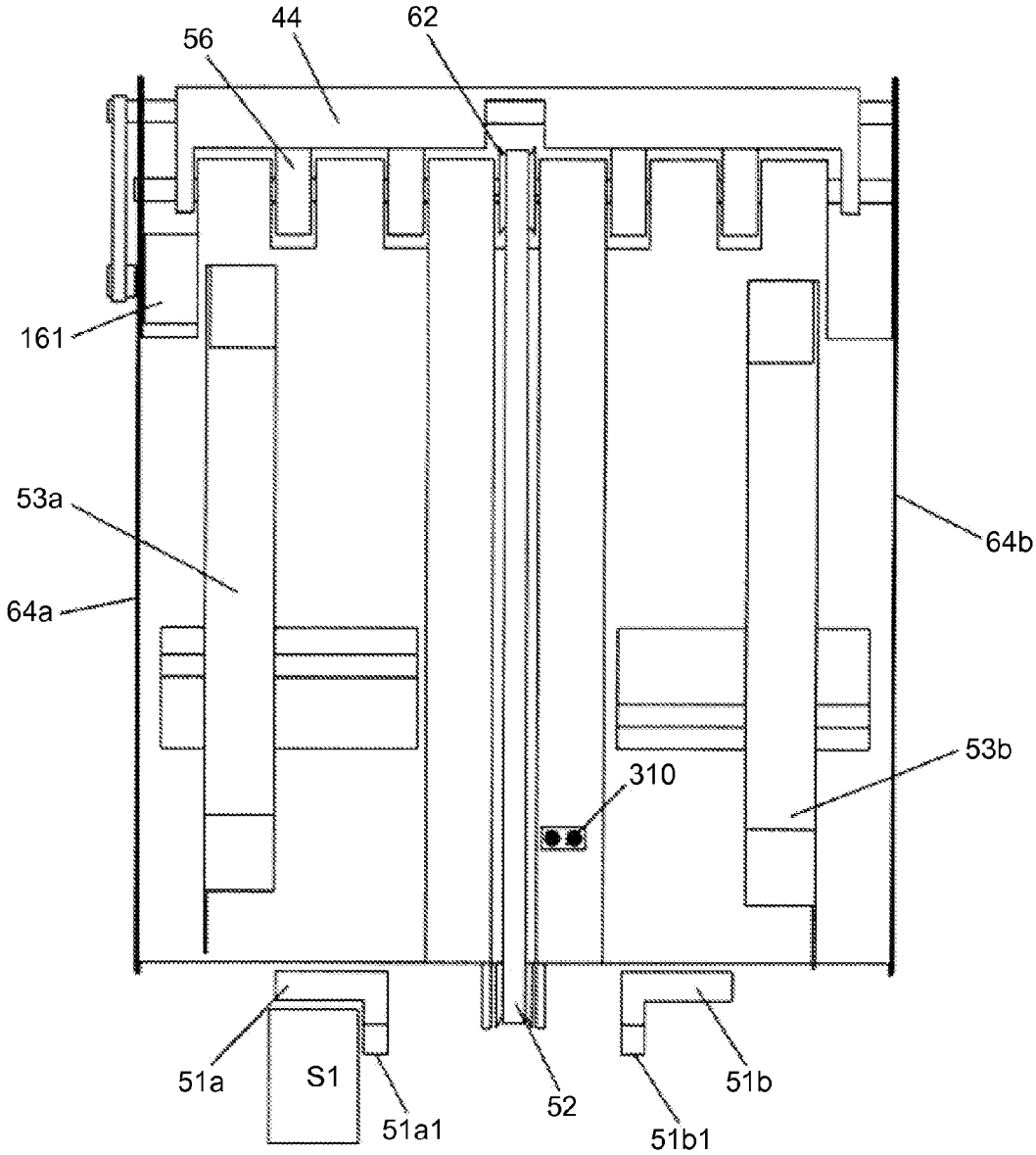
FIG. 2 is a schematic diagram illustrating a configuration of a side-stitching process tray in FIG. 1 viewed from a stacking surface side of the tray.
Figure 4:
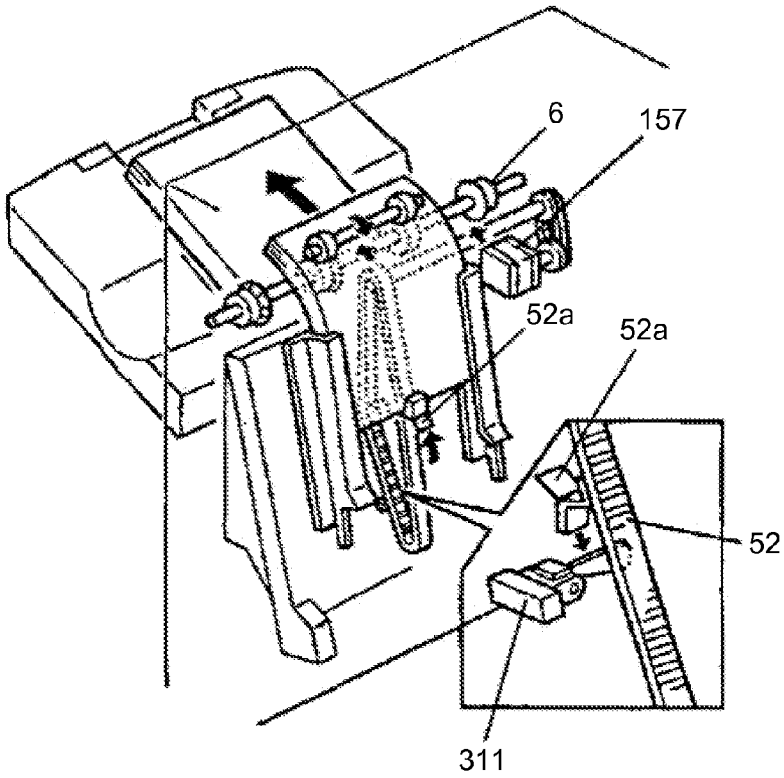
FIG. 4 is a perspective view illustrating an operation of an ejecting belt in FIG. 1.

The ejecting belt 52, as illustrated in FIGS. 2 and 4, is positioned at the alignment center in the sheet width direction, is tightly stretched between pulleys 62, and is driven by an ejecting-belt drive motor 157. A plurality of ejecting rollers 56 are symmetrically arranged with respect to the ejecting belt 52 and are rotatably attached to a drive shaft to serve as driven rollers.

A home position of the ejecting claws 52*a* is detected by an ejecting-belt HP sensor 311, and the ejecting-belt HP sensor 311 is turned on and off by the ejecting claws 52*a* provided on the ejecting belt 52. On the outer circumference of the ejecting belt 52, two pieces of the ejecting claws 52*a* are arranged at positions opposing to each other, and the ejecting claws 52*a* alternately move and convey the sheet bundle accommodated in the side-stitching process tray F. The ejecting belt 52 may be rotated backwards as necessary, so that the leading end of the sheet bundle accommodated in the side-stitching process tray F can be aligned in the conveying direction by the ejecting claw 52*a* ready for moving the sheet bundle and the back face of the ejecting claw 52*a* on the opposite side.

In FIG. 1, a reference numeral 110 represents a trailing-end pressing lever that is positioned at a lower end portion of the trailing-end reference fences 51 such that the trailing end of the sheet bundle accommodated in the trailing-end reference fences 51 can be pressed, and moves back and forth in a direction nearly perpendicular to the side-stitching process tray F. On the sheet discharged to the side-stitching process tray F, the alignment in the vertical direction (sheet conveying direction) is performed by the tapping roller 12 for each sheet. However, when the trailing end of the sheet stacked on the side-stitching process tray F is curled or when the sheet lacks firmness, the trailing end of the sheet tends to buckle and bulge by the weight of the sheet itself. Moreover, as the number of sheets stacked increases, a gap in the trailing-end reference fences 51 through which a subsequent sheet enters becomes narrower, whereby the alignment in the vertical direction tends to be worse. Consequently, what reduces the bulge of the trailing end of sheet to make a subsequent sheet enter the trailing-end reference fences 51 easily is a trailing-end pressing mechanism, and what presses the sheet directly is the trailing-end pressing lever 110.

In FIG. 1, reference numerals 302, 303, 305, and 310 represent sheet detecting sensors, and each of the sensors detects the passage of a sheet or stacking of the sheet at the respective positions provided.

FIG. 2 is a schematic diagram illustrating a configuration of the side-stitching process tray F viewed from the stacking surface side of the tray, and is equivalent to when viewed from the right side in FIG. 1. In FIG. 1, the alignment of the sheet received from the image forming apparatus PR on the upstream side is performed by jogger fences 53*a* and 53*b* in the sheet width direction, and the alignment in the vertical direction is performed by abutting the sheet on trailing-end reference fences 51*a* and 51*b* (indicated by the reference numeral 51 in FIG. 1). The trailing-end reference fences 51*a* and 51*b* include stacking surfaces 51*a*1 and 51*b*1 of inner surfaces, respectively, on which a sheet trailing-end ST (see FIG. 3A) abuts and is held, and are configured to support the sheet trailing-end ST at two points. After the alignment operation is completed, a binding process is performed by the side-stitching stapler S1. As can be appreciated from the perspective view in FIG. 4 illustrating the operation of the ejecting belt, the ejecting belt 52 is driven in the counter-clockwise direction by the ejecting-belt drive motor 157, and the sheet bundle after the binding process is lifted to a given position by the trailing-end reference fences 51*a* and 51*b*, is scooped up by the ejecting claw 52*a* attached on the ejecting belt 52, and is ejected from the side-stitching process tray F. Reference numerals 64*a* and 64*b* represent a front side plate and a back side plate of the side-stitching process tray F, respectively. The above-described operation is operable in the same manner even for an unbound sheet bundle on which binding process is not performed after the alignment process.

Figure 3A:
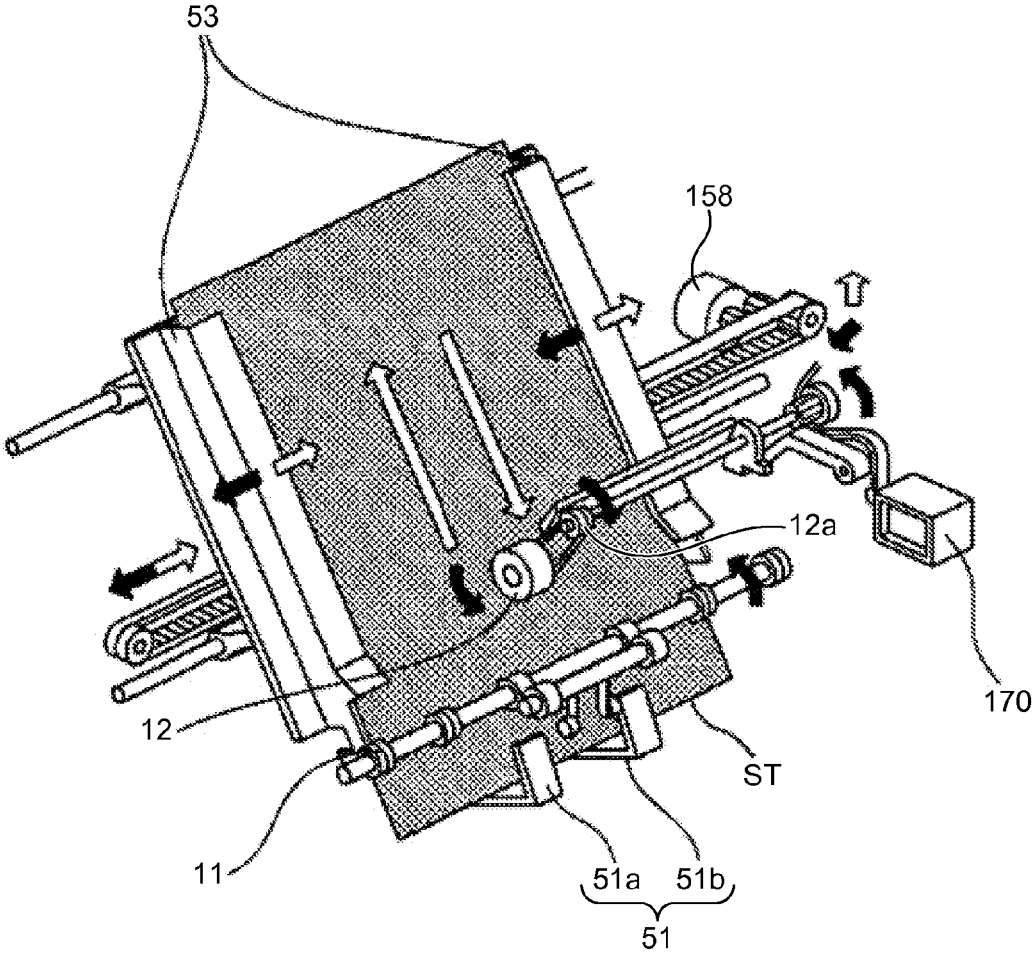
FIG. 3A is a perspective view illustrating the side-stitching process tray and its associated mechanism in FIG. 1.
Figure 3B:
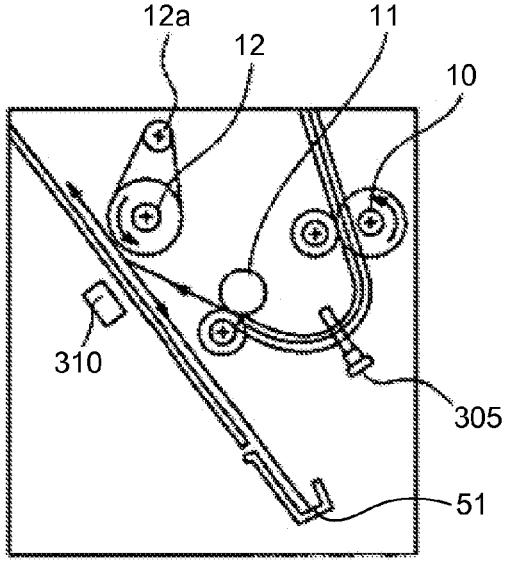
FIG. 3B is a side view illustrating a configuration of main components of the side-stitching process tray and its associated mechanism shown in FIG. 3A.

FIG. 3A is a perspective view schematically illustrating a configuration of the side-stitching process tray F and the associated mechanism thereof, and FIG. 3B is a front view illustrating a configuration of main components of the side-stitching process tray F and the associated mechanism thereof. As illustrated in FIGS. 3A and 3B, the sheets guided to the side-stitching process tray F by the staple discharging rollers 11 are stacked on the side-stitching process tray F in sequence. At this time, when the number of sheets discharged to the side-stitching process tray F is one, for each sheet, the alignment in the vertical direction (sheet conveying direction) is performed between the tapping roller 12 and the trailing-end reference fences 51 and the alignment in the width direction (sheet width direction orthogonal to the sheet conveying direction) by the jogger fences 53*a* and 53*b*. The tapping roller 12 is swung around a fulcrum 12*a* in pendulum motion by a tapping solenoid 170 and intermittently acts on the sheet fed to the side-stitching process tray F to abut the sheet trailing-end ST on the trailing-end reference fences 51. The tapping roller 12 itself rotates in the counter-clockwise direction in FIG. 3. The jogger fences 53 are, as illustrated in FIGS. 2 and 3, provided in a pair (53*a* and 53*b*) in front and back, and are driven via a timing belt by a jogger motor 158 that rotates forwards and backwards to be moved back and forth in the sheet width direction symmetrically to be close to and away from each other.

Figure 5:
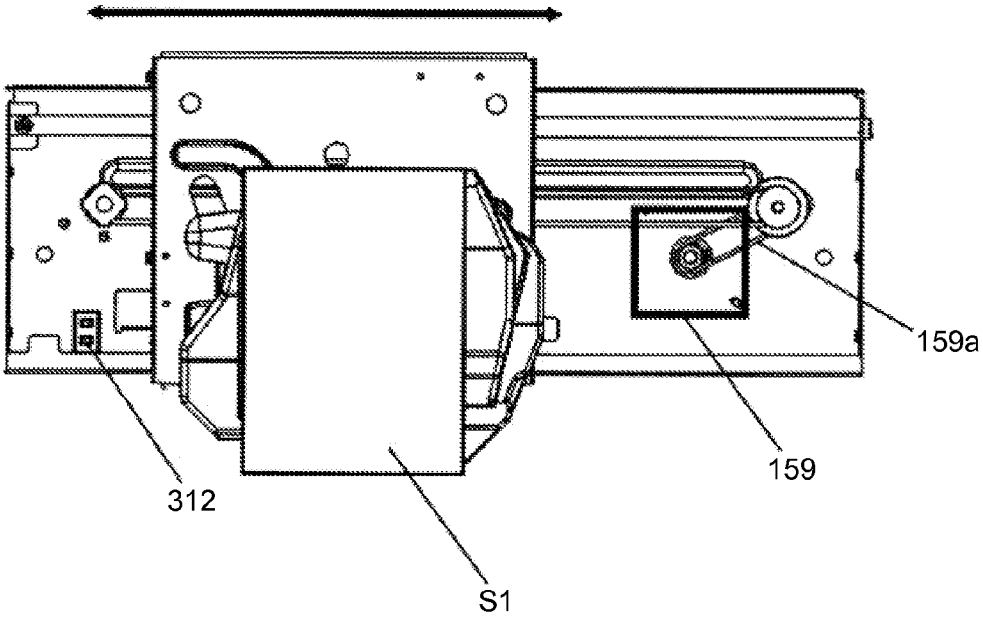
FIG. 5 is a side view illustrating a moving mechanism of a stapler in FIG. 1.

FIG. 5 is a side view illustrating a stapler moving mechanism, and is equivalent to a front view viewed from a stapler mounted side. The side-stitching stapler S1 is, as illustrated in FIG. 5, driven by a stapler moving motor 159 that rotates forwards and backwards via a timing belt 159*a*, and is moved in the sheet width direction to bind the trailing-end portion of the sheet at a given position. On one end of the moving range of the side-stitching stapler S1, a stapler moving HP sensor 312 that detects a home position of the side-stitching stapler S1 is provided, and the binding position in the sheet width direction is controlled by a moving amount of the side-stitching stapler S1 from the home position. The side-stitching stapler S1 is configured to bind the trailing-end portion of the sheet at one point or a plurality of points (typically, two points), and is movable across at least the entire width of the sheet trailing-end ST that is supported by the trailing-end reference fences 51*a* and 51*b*. Furthermore, to replace staples, the side-stitching stapler S1 is made to move maximally towards the front side of the apparatus for the convenience of the user in a staple replacement operation.

Referring back to FIG. 1, on the downstream side of the side-stitching process tray F in the sheet conveying direction, a sheet bundle deflecting mechanism is provided. The conveying paths to route a sheet bundle and the conveying units to convey the sheet bundle from the side-stitching process tray F to the saddle-stitching process tray G or from the side-stitching process tray F to the shift tray 202 are configured with a conveying mechanism 35 that exerts conveying force to the sheet bundle, the ejecting rollers 56 that turns the sheet bundle, and the guide member 44 that guides the sheet bundle to turn.

The respective configurations of the foregoing will be described. The conveying mechanism 35 is configured such that the driving force of a drive shaft 37 is transmitted to a roller 36 via a timing belt. The roller 36 and the drive shaft 37 are connected and supported by an arm, and are configured to rock with the drive shaft 37 as the fulcrum of rotation. The drive of the roller 36 of the conveying mechanism 35 to rock is provided by a cam 40, and the cam 40 rotates around a rotation shaft and is driven by a motor not depicted. In the conveying mechanism 35, a driven roller 42 is arranged at the position facing the roller 36, and the driven roller 42 and the roller 36 nip a sheet bundle, being pressed by an elastic material, to exert the conveying force.

The conveying path that turns the sheet bundle from the side-stitching process tray F to the saddle-stitching process tray G is formed between the ejecting rollers 56 and the inner surface of the guide member 44 on the side facing the ejecting rollers 56. The guide member 44 rotates around its fulcrum, and its drive is transmitted from a bundle bifurcating drive motor 161 (see FIG. 2). When delivering a sheet bundle from the side-stitching process tray F to the shift tray 202, the guide member 44 rotates around the fulcrum in the clockwise direction in FIG. 1, and a space formed between the outer surface of the guide member 44 (the surface on the side not facing the ejecting rollers 56) and a guide plate on the outer side thereof serves as the conveying path. When delivering a sheet bundle from the side-stitching process tray F to the saddle-stitching process tray G, the ejecting claw 52*a* pushes up the trailing end of the sheet bundle that is aligned in the side-stitching process tray F, and the roller 36 of the conveying mechanism 35 and the driven roller 42 facing the roller 36 nip the sheet bundle therebetween to exert the conveying force. At this time, the roller 36 of the conveying mechanism 35 waits at a position where the roller 36 is not hit by the leading end of the sheet bundle. After the leading end of the sheet bundle passes over, the roller 36 of the conveying mechanism 35 is then made to contact the sheet surface to exert the conveying force. At this time, the guide member 44 and the ejecting rollers 56 form a guide for the turn conveying path and convey the sheet bundle to the saddle-stitching process tray G downstream.

The saddle-stitching process tray G is, as illustrated in FIG. 1, provided on the downstream side of the sheet bundle deflecting mechanism composed of the conveying mechanism 35, the guide member 44, and the ejecting rollers 56. The saddle-stitching process tray G is provided nearly vertically on the downstream side of the sheet bundle deflecting mechanism, and is arranged with a center-folding mechanism at the central portion thereof, an upper bundle-conveying guide plate 92 above the center-folding mechanism, and a lower bundle-conveying guide plate 91 below the center-folding mechanism.

Furthermore, upper bundle-conveying rollers 71 are provided at an upper portion of the upper bundle-conveying guide plate 92, lower bundle-conveying rollers 72 are provided at a lower portion thereof, and the upper saddle-stitching jogger fences 250*a* are arranged straddling the both rollers 71 and 72 along the side surfaces of the upper bundle-conveying guide plate 92 on both sides. Likewise, the lower saddle-stitching jogger fences 250*b* are arranged along the side surfaces of the lower bundle-conveying guide plate 91 on both sides, and at the position where the lower saddle-stitching jogger fences 250*b* are provided, the saddle-stitching stapler S2 is arranged. The upper saddle-stitching jogger fences 250*a* and the lower saddle-stitching jogger fences 250*b* are driven by respective driving mechanisms not depicted, and perform an aligning operation in a direction orthogonal to the sheet conveying direction (sheet width direction). The saddle-stitching stapler S2 is composed of a clincher and a driver as a pair, and two pairs of them are provided with a given space therebetween in the sheet width direction.

Moreover, a movable trailing-end reference fence 73 is arranged to cross the lower bundle-conveying guide plate 91, and is movable in the sheet conveying direction (up-down direction in FIG. 1) by a moving mechanism including a timing belt and its driving mechanism. The driving mechanism is, as illustrated in FIG. 1, composed of a drive pulley and a driven pulley with the timing belt stretched therebetween, and a stepping motor that drives the drive pulley. Similarly, on the upper end side of the upper bundle-conveying guide plate 92, a trailing-end tapping claw 251 and its driving mechanism are provided. The trailing-end tapping claw 251 is movable back and forth, by a timing belt 252 and a driving mechanism not depicted, in a direction away from the sheet bundle deflecting mechanism and in a direction to press the trailing end of the sheet bundle (the trailing-end side when the sheet bundle is fed in).

The center-folding mechanism is provided at roughly a central portion of the saddle-stitching process tray G, and is composed of the folding plate 74, the folding rollers 81, and a conveying path H through which a folded sheet bundle is conveyed. In FIG. 1, a reference numeral 326 represents a home position sensor to detect a home position of the trailing-end tapping claw 251, a reference numeral 323 represents a folding unit passing sensor to detect a center-folded sheet bundle, a reference numeral 321 represents a bundle detecting sensor that detects a sheet bundle reaching the center-folding position, and a reference numeral 322 represents a movable trailing-end reference fence home position sensor that detects a home position of the movable trailing-end reference fence 73.

Moreover, in the present embodiment, a detecting lever 501 that detects the height of center-folded sheet bundles stacked in the lower tray 203 is provided to swing around a fulcrum 501*a*, and an angle of the detecting lever 501 is detected by a sheet surface sensor 505, whereby a lifting operation and an overflow detection of the lower tray 203 are performed.

Figure 6:
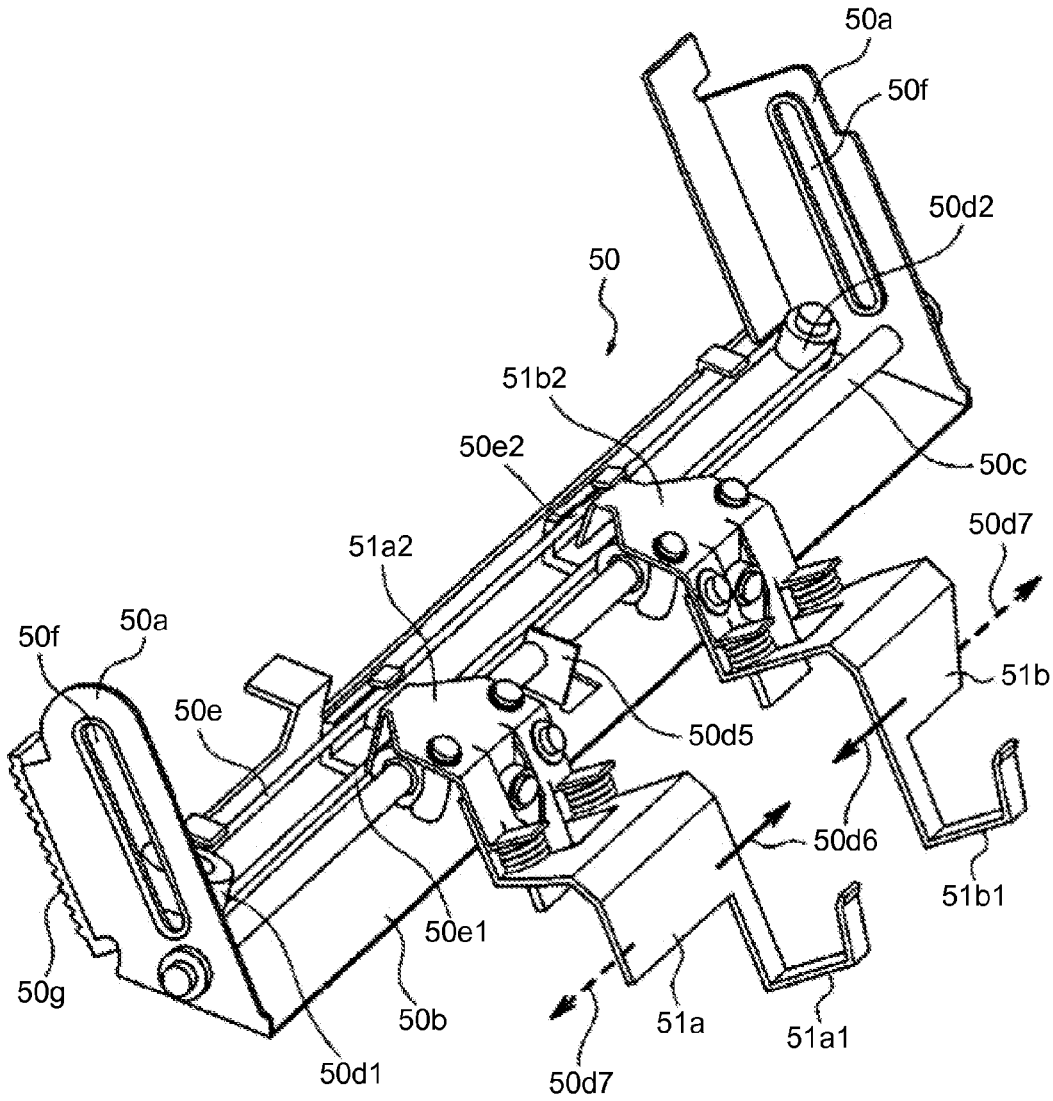
FIG. 6 is a perspective view illustrating a moving mechanism of trailing-end reference fences in a direction orthogonal to a sheet conveying direction.
Figure 7:
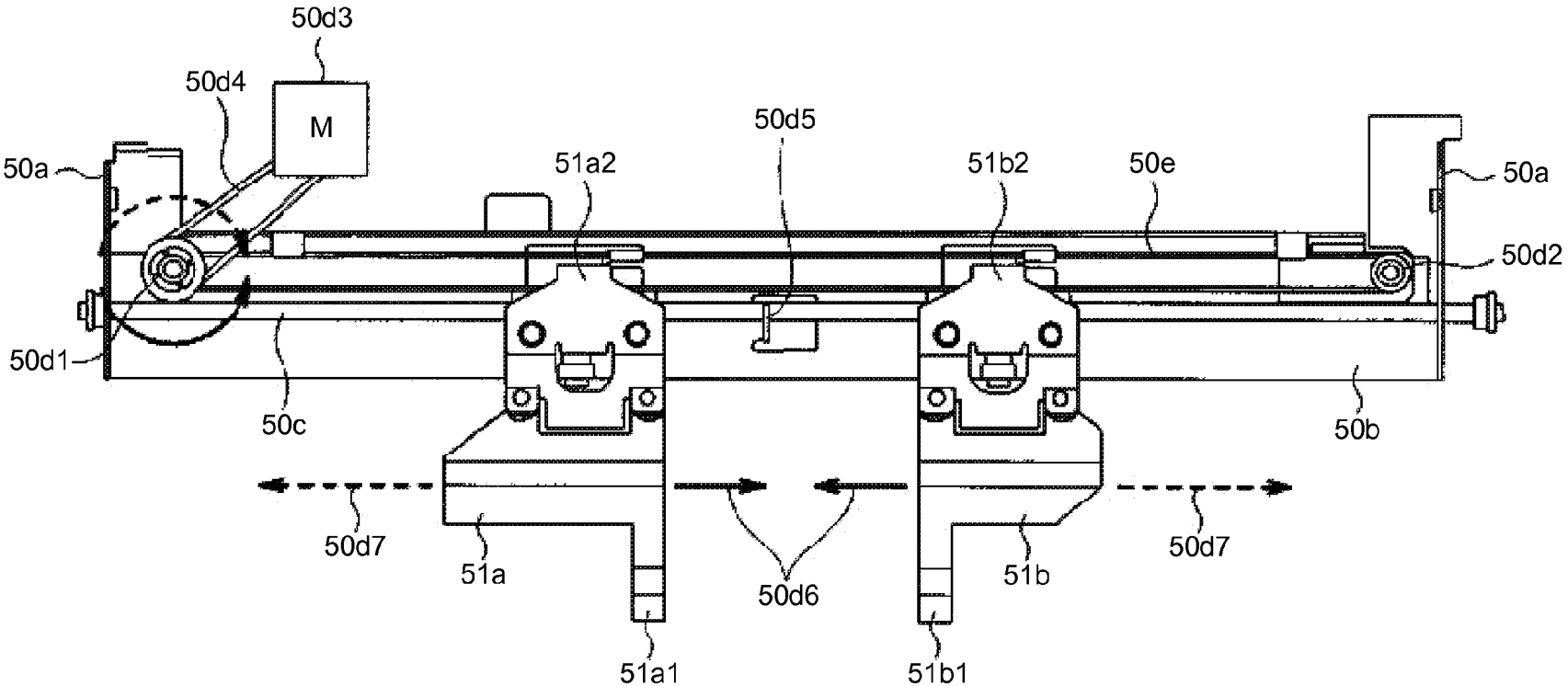
FIG. 7 is a side view of FIG. 6.
Figure 8:
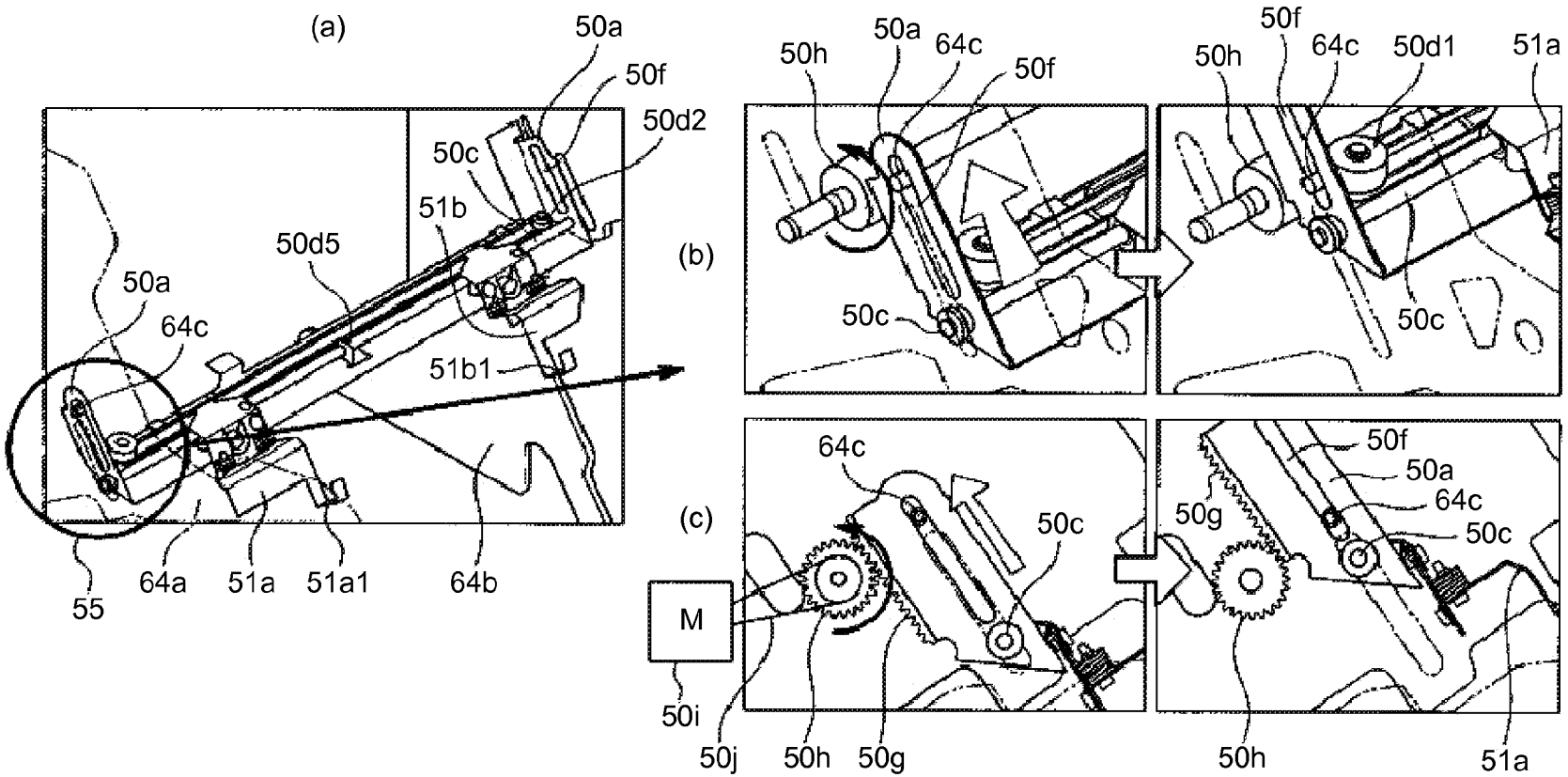
FIG. 8 is a explanatory diagram illustrating a moving mechanism of the trailing-end reference fences in the sheet conveying direction and its operation.

FIG. 6 is a perspective view illustrating a moving mechanism 50 of the trailing-end reference fences in a direction orthogonal to the sheet conveying direction (hereinafter referred to as a width-direction moving mechanism), FIG. 7 is a side view thereof, and FIG. 8 is a explanatory diagram illustrating a moving mechanism 55 of the trailing-end reference fences 51 in the sheet conveying direction (hereinafter referred to as a length-direction moving mechanism) and the operation thereof.

In FIGS. 6 to 8, the width-direction moving mechanism 50 of the trailing-end reference fences includes a base 50*b*, a slide shaft 50*c*, a timing belt 50*e*, and a fence drive motor 50*d*3. On both sides of the base 50*b*, side plates 50*a* are provided in a standing manner. The slide shaft 50*c* is supported by and fixed to both of the side plates 50*a*, and supports supporting members 51*a*2 and 51*b*2 of the trailing-end reference fences 51*a* and 51*b* to be movable and slidable. The timing belt 50*e* is tightly stretched between a timing pulley 50*d*1 on drive side and a timing pulley 50*d*2 on driven side in parallel with the slide shaft 50*c*, and is rotary driven by the timing pulley 50*d*1 on drive side that is driven by the fence drive motor 50*d*3 via a timing belt 50*d*4.

In the width-direction moving mechanism 50, the supporting member 51*a*2 of the trailing-end reference fence 51*a* is attached to one side 50*e*1 of the timing belt 50*e* in parallel and the supporting member 51*b*2 of the trailing-end reference fence 51*b* is attached to the other side 50*e*2 of the timing belt 50*e* to be symmetric to each other with respect to a supporting member 50*d*5 at the center in the width direction. Accordingly, when the timing belt 50*e* rotates to right, for example, the supporting members 51*a*2 and 51*b*2 come closer to each other (arrows 50*d*6 directions) symmetrically with respect to the supporting member 50*d*5, and when the timing belt 50*e* rotates to left, the supporting members 51*a*2 and 51*b*2 move away from the supporting member 50*d*5 (arrows 50*d*7 directions) symmetrically. As a result, the positions of the stacking surfaces 51*a*1 and 51*b*1 and the distance between them can be set by the amount of rotation of the fence drive motor 50*d*3. Therefore, considering the ease and accuracy of control, for example, a stepping motor is used for the fence drive motor 50*d*3.

The length-direction moving mechanism 55 of the trailing-end reference fences 51 includes slide grooves 50*f*, pins 64*c*, a rack 50*g*, a pinion 50*h*, a drive motor 50*i*, and a timing belt 50*j*. The slide grooves 50*f* are formed on the pair of side plates 50*a* vertically provided on the base 50*b* to be parallel with a bottom plate of the side-stitching process tray F. The pins 64*c* are provided in a standing manner on the front side plate 64*a* and on the back side plate 64*b*, and are freely fit to the slide grooves 50*f* to regulate the moving positions of the side plates 50*a* and to allow moving only in a direction parallel to the bottom plate of the side-stitching process tray F. This move is made by the pinion 50*h* to which the driving force of the drive motor 50*i* is transmitted via the timing belt 50*j* and the rack 50*g* that meshes with the pinion 50*h* and is provided on the end face of the side plate 50*a* on one side. In the present embodiment, the length-direction moving mechanism 55 can be set to any position between an initial position illustrated in drawings on left in FIGS. 8(*b*) and 8(*c*) (lowermost position) and a maximally driven position illustrated in drawings on right in FIGS. 8(*b*) and 8(*c*) (uppermost position) by the amount of rotation of the drive motor 50*i*. At the maximally driven position or on the way to the maximally driven position, the delivery of sheet bundle to the ejecting claw 52*a* is performed. In the present embodiment, for example, a stepping motor is also used for the drive motor 50*i* due to the ease and positional accuracy of control. Furthermore, while the pinion 50*h* is driven by the drive motor 50*i* via the timing belt 50*j* in the example illustrated in FIG. 8, the pinion 50*h* can be directly driven by a stepping motor.

Accordingly, the positions of the trailing-end reference fences 51*a* and 51*b* in the sheet width direction are set by the fence drive motor 50*d*3, and the positions of those in the sheet length direction are set by the drive motor 50*i*. The position of a sheet S in the width direction is changed by sheet size and staple position in the width direction, and the position of the sheet S in the length direction is changed corresponding to a setting amount of binding position from the sheet trailing-end ST.

Figure 9:
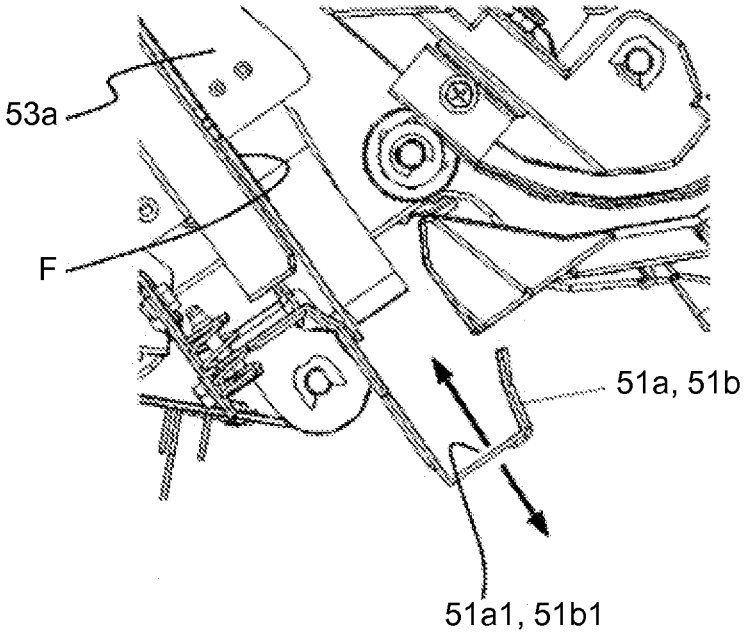
FIG. 9 is a front view illustrating a configuration of main components around a side-stitching stapler in FIG. 1.
Figure 10:
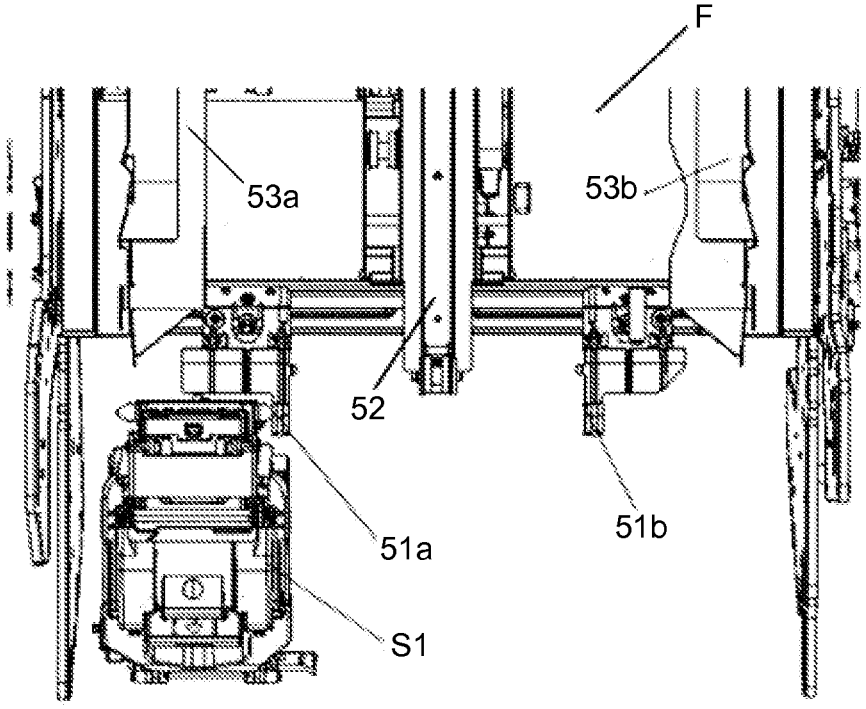
FIG. 10 is a diagram of FIG. 9 viewed from a direction perpendicular to a sheet placement surface of a side-stitching process tray F.

FIG. 9 is a front view illustrating a configuration of main components around the side-stitching stapler in FIG. 1, and FIG. 10 is a diagram of FIG. 9 viewed from a direction perpendicular to a sheet placement surface of the side-stitching process tray F. The sheets are supported by two pieces of the trailing-end reference fences 51*a* and 51*b* in front and back, and the alignment in the sheet width direction that is orthogonal to the sheet conveying direction is performed similarly by two pieces of the jogger fences 53*a* and 53*b* in front and back.

Figure 11:
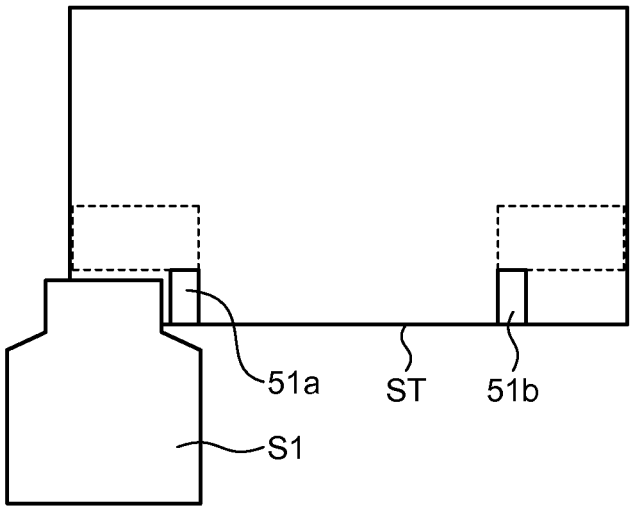
FIG. 11 is an explanatory diagram illustrating a state in which sheets are stacked on the front and back trailing-end reference fences depicted in FIG. 10.
Figure 12:
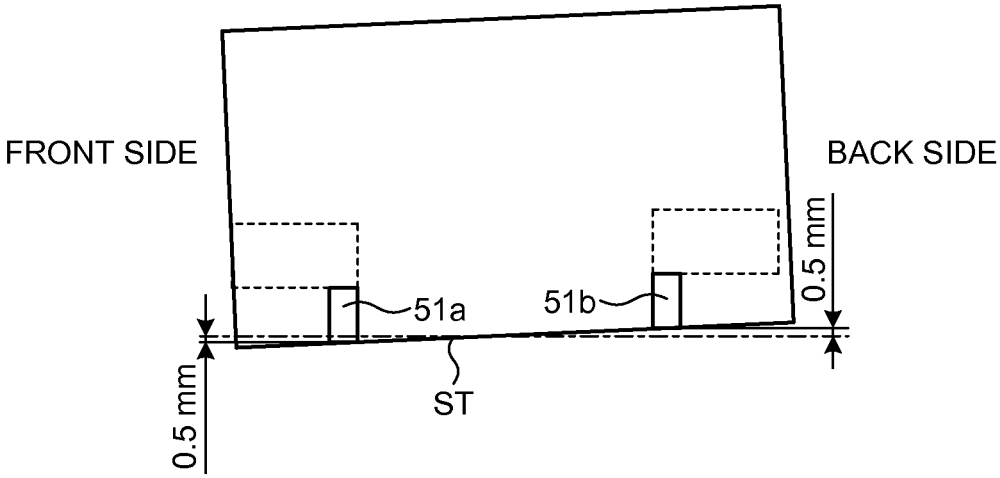
FIG. 12 is an explanatory diagram illustrating a state in which the front and back trailing-end reference fences are assembled out of alignment.
Figure 13:
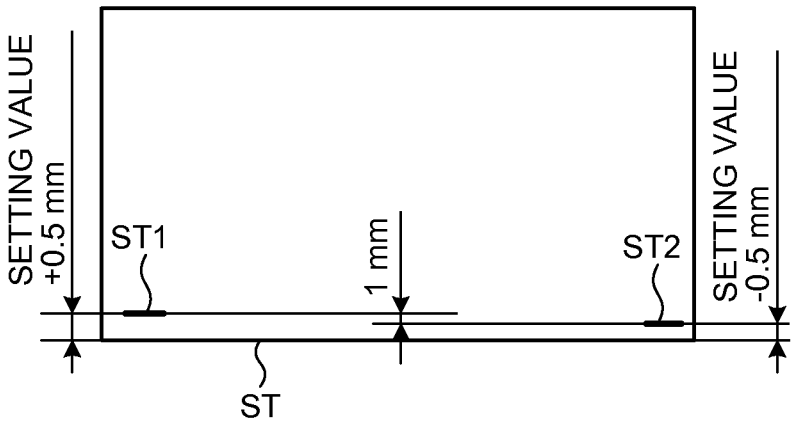
FIG. 13 is an explanatory diagram illustrating the front and back trailing-end reference fences in a state after positional adjustment.
Figure 14:
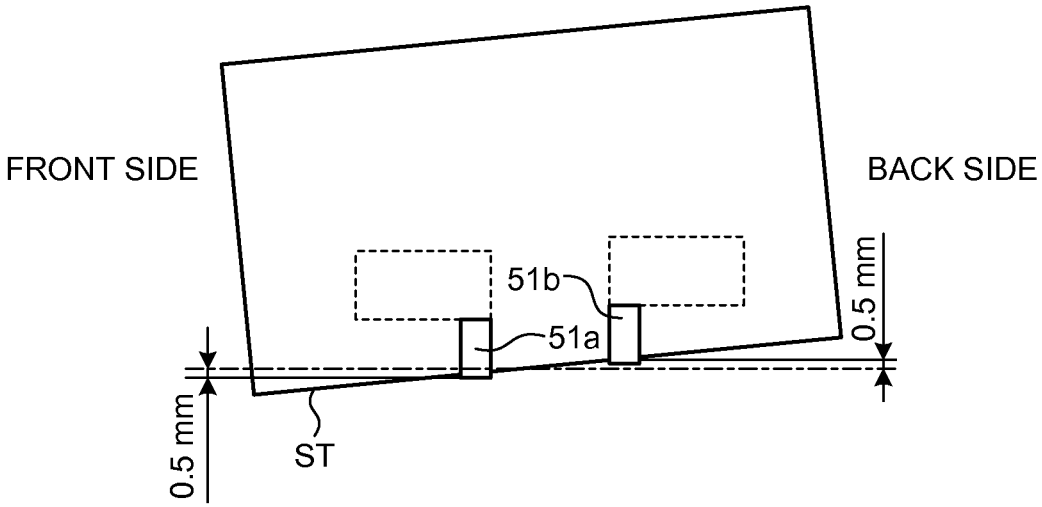
FIG. 14 is an explanatory diagram illustrating a state in which the front and back trailing-end reference fences are narrowly positioned in a width direction.

FIG. 11 is an explanatory diagram illustrating a state in which sheets are stacked on the trailing-end reference fences 51*a* and 51*b* in front and back depicted in FIG. 10, FIG. 12 is an explanatory diagram illustrating a state in which the trailing-end reference fences 51*a* and 51*b* are assembled out of alignment, FIG. 13 is an explanatory diagram illustrating the trailing-end reference fences 51*a* and 51*b* in a state after positional adjustment, and FIG. 14 is an explanatory diagram illustrating a state in which the trailing-end reference fences 51*a* and 51*b* are narrowly positioned in the width direction.

As illustrated in FIG. 11, when the trailing-end reference fences 51*a* and 51*b* are assembled at ideal positions, the relative position between the sheet and the stapler S1 in the conveying (sub-scanning) direction is constant. Therefore, wherever the side-stitching stapler S1 moves in the sheet width direction for performing stapling process, the binding depth in the conveying (sub-scanning) direction is constant.

However, for example, as illustrated in FIG. 12, when the trailing-end reference fence 51*a* in front is assembled 0.5 millimeters deeper (below) with respect to the ideal position and the trailing-end reference fence 51*b* in back is assembled 0.5 millimeters shallower (above) with respect to the ideal position, deviations in binding position in the conveying (sub-scanning) direction arise when front-side binding is made and when back-side binding is made, thereby resulting in bound positions as illustrated in FIG. 13. When front-side binding is performed in a state illustrated in FIG. 12, the front side is bound 0.5 millimeters deeper than the ideal position (staple position ST1), whereas the back side is bound 0.5 millimeters shallower than the ideal (staple position ST2). When the adjustment of binding position is made, for example, by changing the fixed position of the side-stitching stapler S1 so that the front-side binding is made at the ideal position as illustrated in FIG. 13, the back-side binding deviates from the ideal position by one millimeter.

Accordingly, in the present embodiment, by leveraging that the positions of the trailing-end reference fences 51*a* and 51*b* are movable in the sheet conveying direction (sheet length direction) as illustrated in FIGS. 8 to 9, no deviations of binding positions in front and back are made to occur in the conveying (sub-scanning) direction even when there is a discrepancy between the positions of the front and back trailing-end reference fences 51*a* and 51*b* as in the foregoing. Specifically, the adjustment is made as follows.

When the front and back trailing-end reference fences 51*a* and 51*b* are assembled and are displaced in the conveying (sub-scanning) direction as in the foregoing, by changing the standby positions of the trailing-end reference fences 51*a* and 51*b* when stacking sheets for front-side binding and for back-side binding, the relative positions between the sheet and the side-stitching stapler S1 at staple positions are made constant. For example, when there is a discrepancy as illustrated in FIG. 12, the standby position of the trailing-end reference fence is adjusted 0.5 millimeters shallower (above) than the ideal position when the front-side binding is performed as illustrated in FIG. 13, and when the back-side binding is performed, the trailing-end reference fence is adjusted 0.5 millimeters deeper (below) than the ideal position. Consequently, the relative positions between the sheet and the side-stitching stapler S1 at the binding positions become constant (ideal position).

The adjustment of binding position is made based on measured values of the staple positions ST1 and ST2 of a sheet bundle (distances from the sheet trailing-end ST) that are measured by actually binding the sheet bundle for each sheet post-processing apparatus PD at the time of inspection before factory shipment. Alternatively, when the sheet post-processing apparatus PD is installed at a user's site, a stapling process is performed in the same manner and the adjustment is then made based on the measured result of the staple positions ST1 and ST2. As for the adjustment values (amount of changes), the amount of changes are written to a ROM from the outside in the former situation, and in the latter situation, the adjustment values are entered from, for example, an operation panel 105 as described later.

When the sheet supporting positions of the trailing-end reference fences 51*a* and 51*b* are closer to the central portion as illustrated in FIG. 14, the inclination of stacked sheets becomes greater even though the deviations of the trailing-end reference fences in assembling are the same, and thus it is necessary to make the amount of adjustment larger. Similarly, as the binding position in the width direction is further out from the center of the sheet, it is necessary to make the amount of adjustment larger. Consequently, the adjustment values for the front and back trailing-end reference fences 51*a* and 51*b* are the values determined by geometric conditions of deviations of the front and back trailing-end reference fences 51*a* and 51*b*, sheet supporting positions, and binding positions (in the sheet width direction).

While single-point binding has been exemplified, even in two-point binding, it is similarly affected by the positional deviations of the front and back trailing-end reference fences 51*a* and 51*b*, and thus the binding positions in front and back (in the sub-scanning direction) are displaced. Accordingly, in two-point binding, when the side-stitching stapler S1 moves from the first point to the second point, the positions of the trailing-end reference fences 51*a* and 51*b* are changed (adjusted) to move the sheet to the position where the positional deviations between the front and back trailing-end reference fences 51*a* and 51*b* are compensated, whereby the binding positions (in the sub-scanning direction) can be positioned at an ideal position.

In the present embodiment, the relative position between the sheet and the stapler is adjusted by adjusting the positions of the trailing-end reference fences 51*a* and 51*b* in the sheet conveying direction (sub-scanning direction). However, by configuring the side-stitching stapler S1 to be movable in the conveying (sub-scanning) direction, the adjustment of position of the side-stitching stapler S1 in the conveying direction has the same effect, and the embodiment can be configured as such. However, because the side-stitching stapler S1 is heavier and larger than the trailing-end reference fences 51*a* and 51*b*, it is more practical to configure the trailing-end reference fences 51*a* and 51*b* to be movable.

Figure 15:
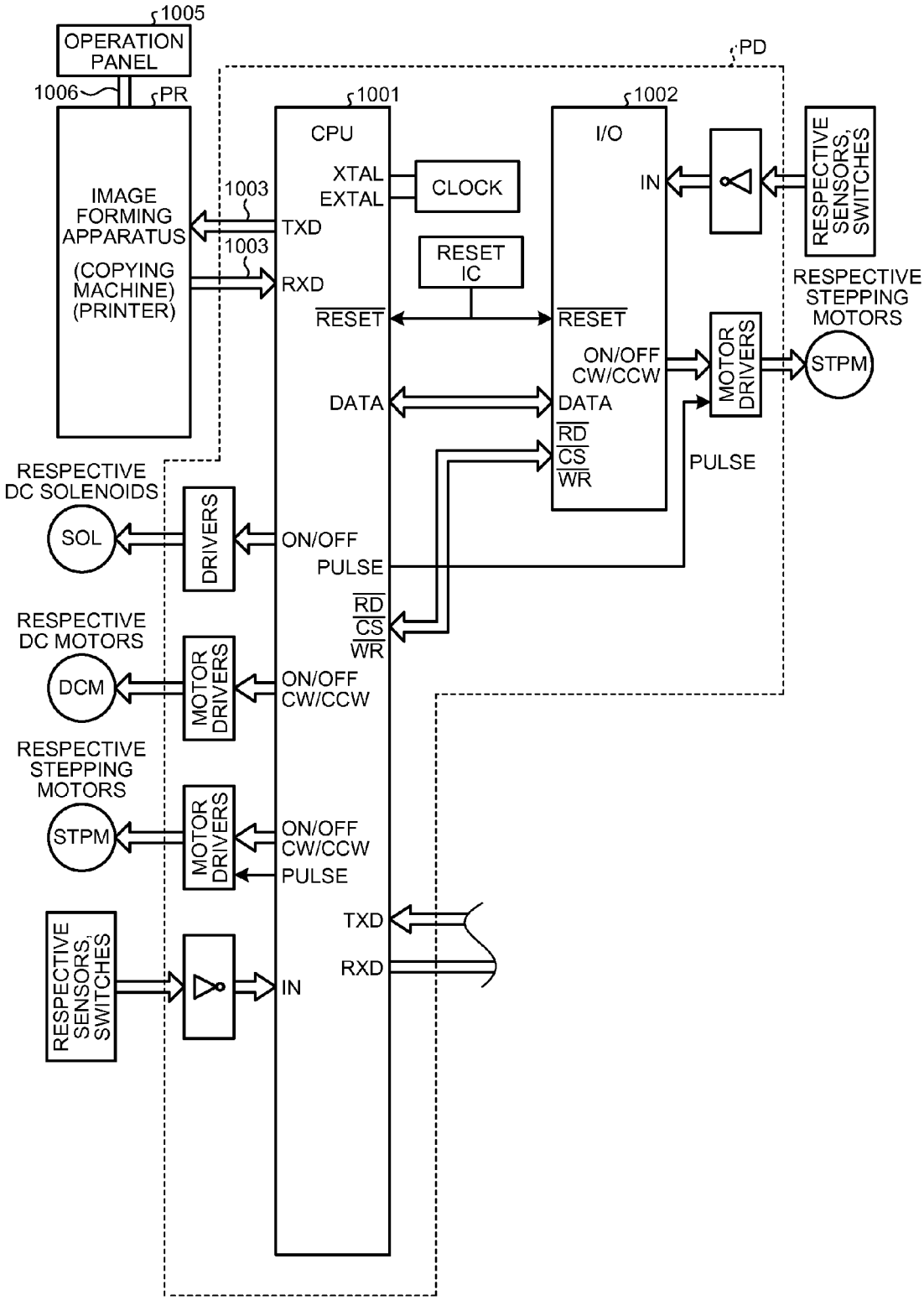
FIG. 15 is a block diagram illustrating a control configuration of the image forming system composed of the sheet post-processing apparatus and the image forming apparatus.

FIG. 15 is a block diagram illustrating a control configuration of the image forming system composed of the sheet post-processing apparatus PD and the image forming apparatus PR. The sheet post-processing apparatus PD includes a control circuit mounted with a microcomputer having a CPU 1001, an I/O interface 1002, and others. The CPU 1001 receives a signal from a CPU of the image forming apparatus PR or signals from respective switches and such of the operation panel 1005 and respective sensors not depicted via a communication interface 1003, and the CPU 1001 performs a given control based on the signal received. The CPU 1001 further controls to drive solenoids and motors via respective drivers and motor drivers, and acquires sensor information in the apparatus from an interface. The CPU 1001 further controls, corresponding to control subjects or sensors, to drive motors by motor drivers or to acquire sensor information from the sensors via the I/O interface 1002. As for the control, the CPU 1001 reads out a program code stored in a ROM not depicted, loads the program code onto a RAM not depicted, and performs the control based on a program defined by the program code using the RAM as a work area and a data buffer.

Furthermore, the control of the sheet post-processing apparatus PD in FIG. 15 is performed based on commands or information from the CPU of the image forming apparatus PR. The operational instructions are made by the user from the operation panel 1005 of the image forming apparatus PR. The image forming apparatus PR and the operation panel 1005 are connected with each other via a communication interface 1006. Therefore, the image forming apparatus PR transmits an operation signal from the operation panel 1005 to the sheet post-processing apparatus PD, and the user or an operator is notified of processing status and functions of the sheet post-processing apparatus PD via the operation panel 1005. Accordingly, the binding depth can be set by the user from the operation panel 1005 of the image forming apparatus PR according to a type of binding process (front-side binding/back-side binding/two-point binding, flat stapling/slant stapling) and a sheet type (coated paper, heavy paper, and such). Furthermore, by leveraging that the trailing-end reference fences 51*a* and 51*b* are configured to be movable in the conveying direction, a mode for fine adjustment of binding position by service personnel may be provided.

As in the foregoing, the present embodiment provides the following effects.

1) When the front and back trailing-end reference fences 51*a* and 51*b* are displaced in the conveying (sub-scanning) direction, and thus the positional deviations of binding positions on front side and on back side arise in the sub-scanning direction, the binding positions in the sub-scanning direction on front side and on back side can be made the same by changing the standby positions of the trailing-end reference fences 51*a* and 51*b* in front-side binding and in back-side binding for the amount of displacement to adjust the biding positions.

2) The adjustment of the binding positions can compensate the mechanical positional deviation between the front and back trailing-end reference fences 51*a* and 51*b* by controllably changing the standby position of only the trailing-end reference fence 51*b* on back side for the amount of mechanical positional deviation between the front and back trailing-end reference fences 51*a* and 51*b* in the sub-scanning direction when back-side binding is performed.

A sheet-conveying direction trailing-end portion in the appended claims corresponds to the sheet trailing-end ST in the present embodiment. A pair of alignment members corresponds to the front and back trailing-end reference fences 51*a* and 51*b*; a binding unit corresponds to the side-stitching stapler S1; a moving unit corresponds to the length-direction moving mechanism 55 including the slide grooves 50*f*, the pins 64*c*, the rack 50*g*, the pinion 50*h*, the drive motor 50*i*, and the timing belt 50*j*; a position changing unit corresponds to the CPU 101; a changing amount setting unit corresponds to the operation panel 105 and the CPU 101; binding positions correspond to ST1 and ST2; a sheet processing apparatus corresponds to the sheet post-processing apparatus PD; and an image forming system corresponds to the image forming apparatus PR and the sheet post-processing apparatus PD.

The present invention allows aligning the binding positions in the sub-scanning direction regardless of the binding position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a pair of alignment members, movable along a sheet-conveying direction trailing-end portion and on which the sheet conveying direction trailing-end portion of a sheet abuts, configured to align the sheet-conveying direction trailing-end portion;

a binding unit, movable along the sheet-conveying direction trailing-end portion, configured to bind a bundle of aligned sheets;

a moving unit configured to move the pair of alignment members in a sheet conveying direction;

a position changing unit configured to drive the moving unit to change a position of one of the pair of alignment members in the sheet conveying direction relative to a position of the other one of the pair of alignment members in the sheet conveying direction, wherein the position changing unit is further configured to change the position of the one of the pair of alignment members such that distances from the sheet-conveying direction trailing-end portion to binding positions are made equal in front-side binding and in back-side binding; and a changing amount setting unit configured to set a changing amount, to make the distances equal in the front-side binding and in the back-side binding, based on one of a sheet size, abutting positions of the pair of alignment members in a sheet width direction, and binding positions in the sheet width direction.

2. An image forming system comprising:

a sheet processing apparatus, the sheet processing apparatus including a pair of alignment members, is movable along a sheet-conveying direction trailing-end portion and on which the sheet conveying direction trailing-end portion of a sheet abuts, configured to align the sheet-conveying direction trailing-end portion;

a binding unit, movable along the sheet-conveying direction trailing-end portion, configured to bind a bundle of aligned sheets;

a moving unit configured to move the pair of alignment members in a sheet conveying direction;

a position changing unit configured to drive the moving unit to change a position of one of the pair of alignment members in the sheet conveying direction relative to a position of the other one of the pair of alignment members in the sheet conveying direction, wherein the position changing unit is further configured to change the position of the one of the pair of alignment members such that distances from the sheet-conveying direction trailing-end portion to binding positions are made equal in front-side binding and in back-side binding; and a changing amount setting unit configured to set a changing amount, to make the distances equal in the front-side binding and in the back-side binding, based on one of a sheet size, abutting positions of the pair of alignment members in a sheet width direction, and binding positions in the sheet width direction.

3. A sheet processing method for binding a sheet bundle performed by a binding unit in a sheet processing apparatus, the sheet processing apparatus further including a pair of alignment members that are movable along a sheet-conveying direction trailing-end portion and on which the sheet-conveying direction trailing-end portion of a sheet abuts to align the sheet-conveying direction trailing-end portion, the binding unit being configured to move along the sheet-conveying direction trailing-end portion and bind a bundle of aligned sheets, and a moving unit configured to move the pair of alignment members in a sheet conveying direction, the sheet processing method comprising:

changing binding positions of the sheet bundle by moving at least one of the pair of alignment members, via the moving unit, in the sheet conveying direction wherein the changing includes changing the position of one of the pair of alignment members such that distances from the sheet-conveying direction trailing-end portion to binding positions are made equal in front-side binding and in back-side binding, and wherein a changing amount is set, to make the distances equal in the front-side binding and in the back-side binding, based on one of a sheet size, abutting positions of the pair of alignment members in a sheet width direction, and binding positions in the sheet width direction.

* * * * *